US006357906B1

(12) United States Patent
Baudoin et al.

(10) Patent No.: US 6,357,906 B1
(45) Date of Patent: Mar. 19, 2002

(54) METHOD AND DEVICE FOR MIXING A BULK MATERIAL WITH A FLUID

(76) Inventors: Michael P. Baudoin, 103 Westward, Scott, LA (US) 70583; Philip L. Broussard, 509 Presbytere Pkwy., Lafayette, LA (US) 70503

( * ) Notice: Subject to any disclaimer, the term of this patent is extended or adjusted under 35 U.S.C. 154(b) by 0 days.

(21) Appl. No.: 09/327,837

(22) Filed: Jun. 8, 1999

(51) Int. Cl.[7] ..... B01F 5/02

(52) U.S. Cl. ..... 366/163.2; 366/136; 366/137.1; 366/173.2; 366/183.2

(58) Field of Search ..... 366/137.1, 173.2, 366/178.2, 181.1, 181.2, 182.2, 182.4, 183.2, 136, 163.1, 163.2, 167.1, 173.1

(56) References Cited

U.S. PATENT DOCUMENTS 1,734,164 A * 11/1929 Faber
4,323,314 A * 4/1982 Kaiser-wirz
4,430,001 A * 2/1984 Schuur
4,491,414 A * 1/1985 Hayatdavoudi et al. ..... 366/6
5,344,619 A * 9/1994 Larwick et al.
5,609,417 A * 3/1997 Otte
5,779,355 A * 7/1998 Pullman ..... 366/137
6,109,778 A * 8/2000 Wilmer
6,186,657 B1 * 2/2001 Fuchsbichler
6,234,664 B1 * 5/2001 Tromley

OTHER PUBLICATIONS

Drilling Practices Manual, Preston L. Moore, Chapt. 16, pp. 416–419.

* cited by examiner

*Primary Examiner*—Charles E. Cooley
(74) *Attorney, Agent, or Firm*—Domingue & Waddell, PLC

(57) ABSTRACT

A product mixing apparatus and method of using a mixing apparatus. In one embodiment, the apparatus comprises a hopper containing the product, with the hopper having a throat section extending therefrom. The throat section has a first injection member configured for injecting a solution into the throat section. The apparatus further contains a mixing chamber connected with the throat section, with the mixing chamber containing a second injection member configured for injecting the solution into the mixing chamber and mixing the product with the solution to form a slurry. A liquid barrier line in fluid communication with the throat section is included in order to keep a head of liquid above the jet within the mixing chamber. An exit line extending from the mixing chamber in order to withdraw the slurry may also be included. In one embodiment, the first injection member is a nozzle positioned being positioned so as to deliver the solution into the throat section under a pressure. The injection of the solution into the throat section removes trapped and entrained air within the product. The nozzle member within the mixing chamber may contain multiple nozzles for delivering the solution under a high pressure.

5 Claims, 5 Drawing Sheets

METHOD AND DEVICE FOR MIXING A BULK MATERIAL WITH A FLUID

BACKGROUND OF THE INVENTION

This invention relates to a mixing device and method. More particularly, but not by way of limitation, this invention relates to a mixing device for mixing a material and eliminating entrained air while the material is being mixed.

Mixing devices for materials are well known in the art. For instance, in the oil and gas drilling industry, hoppers are used to transport, mix and blend drilling fluids, sometimes referred to as drilling mud. Also, the oil and gas industry has used hoppers to transport, mix and blend cement. These materials being mixed are generally bulky, dry, granular and high density.

As will be appreciated by those of ordinary skill in the art, the materials will be blended in order to reach a consistency of composition and/or consistency of desired density. These parameters are often critical in order to obtain desired results of the ultimate use of the materials. Additionally, the final composition may be critically important in relation to safety of personnel and the environment. Thus, the proper and thorough mixing of these materials is very important.

The components used in drilling fluids may be barite and/or bentonite and/or attapulgite clay, for instance. Barite and cement have a high density and are bulk material. Bentonite, clay and lost circulation material are low density and in and clay have and are bulk material. Generally, a Portland cement is used in the form of finely divided, gray powder composed of lime, alumina, silica, and iron oxide as tetra calcium alumino ferrate. During the process of preparing these types of materials for use, the operator will mix the materials with other components or ingredients, such as water. A problem encountered when mixing with prior art hopper systems is the material being feed down the hopper may contain air and/or entrain air. This air adversely effects the quality of the final product. Another problem with prior art mixing devices includes the clogging of the jets used in the mixing chamber.

Therefore, there is a need for a mixing device that will eliminate air from the material being mixed. Also, there is a need for an apparatus and method for mixing high and low density materials. There is also a need for an apparatus and method that quickly and efficiently mixes high and low density materials.

SUMMARY OF THE INVENTION

A product mixing apparatus is disclosed. In one embodiment, the apparatus comprises a hopper containing the product, with the hopper having a throat section extending therefrom. The hopper has a first injection means for injecting a solution into the hopper. The apparatus further contains a mixing chamber connected with the throat section, with the mixing chamber containing a second injection means for injecting the solution into the mixing chamber and mixing the product with the solution to form a slurry. A liquid barrier line in fluid communication with the throat section, with the liquid barrier line capable of delivering a liquid into the inner diameter of the throat section. An exit line extending from the mixing chamber in order to withdraw the slurry may also be included.

In one embodiment, the first injection means contains a nozzle member positioned in a downward direction, with the nozzle member being positioned so as to deliver the solution into the hopper and throat section under a pressure. In another embodiment, the first injection means may contain a plurality of nozzles positioned about the inner diameter of the hopper, the plurality of nozzles being positioned in a downward fashion. In yet another embodiment, the first injection means contains a circular injection member positioned about the inner diameter of the hopper, with the circular injection member containing a plurality of nozzles.

In another embodiment, the second injection means is a jet nozzle, with the jet nozzle being connected to a pump member for delivering the solution under a pressure, which in the preferred embodiment is a pressure equal to or less than 200 psi. In yet another embodiment, the second injection means may include a first jet nozzle and a second jet nozzle, with the first and second jet nozzle being connected to a pump member for delivering the solution under a low pressure. In this embodiment, the apparatus further comprises a second exit line associated with the second jet nozzle, and a ceramic plate positioned between the first and second jet nozzle, with the ceramic plate acting to channel the stream from the first jet nozzle to the first exit line and channel the stream from the second jet nozzle to the second exit line. The apparatus may also include a directional cleaning nozzle positioned in the throat section, with the directional cleaning nozzle being angled to deliver the solution to the jet nozzles.

Also disclosed is a method of mixing a material. The material may be a high or low density bulk material or a fluid. The method generally comprises placing the material into a hopper, with the hopper having a throat section and a mixing chamber extending therefrom. The method then includes descending the material into the hopper and injecting a solution into the hopper. The solution may be water or any other solution used to treat or combine with the material. A liquid is communicated into the throat section just above the mixing chamber so that a barrier of liquid is kept above the mixing chamber jets that keeps air from mixing in the fluid.

The method may further include channeling the bulk material and the solution via the throat into the mixing chamber and injecting another solution into the mixing chamber with an injection means to form a slurry. Next, the slurry is exited from the mixing chamber.

In one embodiment, the step of injecting the solution includes injecting the fluid into a plurality of nozzles positioned within an inner diameter of the throat section. Additionally, the step of injecting the solution may be performed with a pump means for pumping the solution into the throat section. In yet another embodiment, the step of injecting the drilling fluid comprises a first nozzle and a second nozzle, both positioned within the mixing chamber, and a ceramic plate positioned between the first nozzle and the second nozzle, and wherein the step of exiting the slurry includes exiting from a first and second outlet line.

An advantage of the present invention includes reducing trapped and entrained air from the material that is being mixed. Another advantage is that the apparatus and method may be used with bulk materials such as drilling mud, loss circulation material and cement. Alternatively, the apparatus and method may be used to mix liquids.

Yet another advantage is that the novel invention aids in mixing high and low density products, and therefore, the product is easier to pump. The invention works particularly well with low density products. Still yet another advantage is that the mixing will improve presolubilization of dry products. Another advantage is that the slurry will be of a more uniform consistency, and therefore, it will make the slurry more predictable and safer in its ultimate use.

A feature is that the liquid barrier line provides enough of a liquid volume above the jets in the mixing chamber to create a barrier of liquid above this jet thus keeping the air out of the mixing chamber. Another feature of the liquid barrier line is that it is large enough to allow a sufficient amount of fluid from the tank to gravity feed into the throat above the mixing chamber thereby providing a continuous liquid column above the mixing chamber jets. Another feature of the present invention is the venturi effect created by the jets in the throat and mixing chamber. Another feature is the nozzle in the throat section introducing a solution under pressure. Yet another feature is the implementation of two jet nozzles within the mixing chamber. Still yet another feature is the use of a plate to direct the output from the jet nozzles to the output lines. Another feature is that multiple nozzles may be situated about the throat. Yet another feature is that a cleaning nozzle may be used for cleaning the mixing chamber jets.

DETAILED DESCRIPTION OF THE PREFERRED EMBODIMENTS

Figure 1:
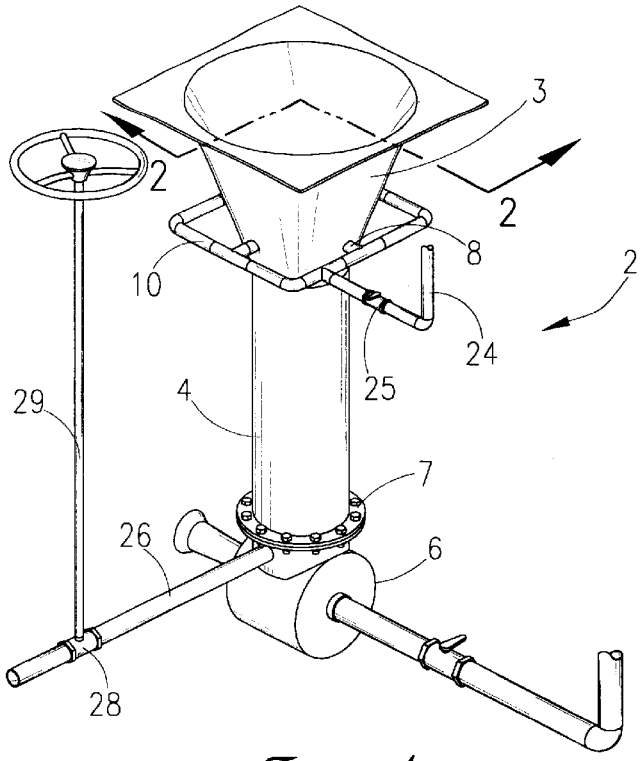
FIG. 1 is a perspective view of the first embodiment of the present invention.

Referring now to FIG. 1, the first embodiment of the present invention will now be described. The mixing apparatus will include a hopper 2, with the hopper 2 having a funnel shaped inlet 3 that allows for the placement of a material. The material being placed into the hopper may be a bulk material such as drilling mud, lost circulation material or cement. It is within the scope of this invention that the material being placed into the hopper could also be a fluid. Hoppers are commercially available from Hal Oil Field Pump & Equipment Corporation under the mark Halco Hoppers.

In the preferred embodiment, the material is a drilling mud and the hopper 2 is associated with mud tanks on a drilling rig for the purpose of drilling, completing, and cementing a well bore to a subterranean reservoir. The operator will place the bulk material (dry bentonite or barite, for instance) within the hopper 2 and the bulk material will be allowed to descend via gravity feed, as is well understood by those of ordinary skill in the art.

In accordance with the teachings of the present invention, the apparatus is part of an installation on a drilling rig. The material that is ultimately mixed within the hopper 2 is placed into a well bore. Thus, the bulk material is placed into the apparatus in order to mix and blend the bulk material into a slurry of known consistency and properties for placement into a well bore. The slurry is placed into the well bore via a tubular member such as a drill string. The slurry can be circulated into the well bore for the performance of known procedures such as drilling, completing, cementing, controlling lost circulation, lubricating the work string, etc.

The funnel 3 extends to the throat section 4 which is generally a cylindrical section having an inner diameter and an outer diameter. The material will descend from the hopper 2 to the inner diameter of the throat section 4 to the mixing chamber 6 which is also referred to as the mixing bowl 6. The throat section 4 is connected with the mixing chamber 6 via a means 7 for connecting and attaching the throat section 4 with the mixing chamber 6, which may be bolts as shown, or alternatively may be welded.

The funnel section 3 will have a plurality of openings 8 that is attached to an input manifold 10. The input manifold 10 is operatively associated with a pump member 12, with the pump member 12 being in the preferred embodiment a centrifugal pump 12 capable of pumping a solution. The pump 12 will pump the solution contained within the reservoir via the manifold line 10 to the injection means for injecting the solution into the inner diameter of the throat 4. In the preferred embodiment, the pump 12 will pump a solution such as water or chemicals that will act to mix and blend the materials being fed into the mixing chamber 6 via the hopper 2. The injection means will be jet nozzles 14,16,18,20. The jet nozzles, as seen in the FIGS. 2, 4, 5, and 6, are generally a projecting spout through which gas, liquid or bulk material is discharged as is understood by those of ordinary skill in the art. The terms nozzle, jet nozzle, and nozzle are used interchangeably herein.

In the preferred embodiment, the jet nozzles 14,16,18,20 are positioned within the inner diameter of the funnel section 3 of the hopper 2. It should be noted that the manifold 10 and the jet nozzles 14,16,18,20 may have been positioned about the throat section 4. In the preferred embodiment, the jet nozzles 14,16,18,20 are directed so that the solution thus injected will be delivered in a downward fashion relative to the path of the material descending the throat 4. The positioning of the jet nozzles 14,16,18,20 will inject the solution into the descending material thereby reducing the amount of entrained and/or trapped air.

While in the preferred embodiment there have been four nozzles positioned within the inner diameter, it is possible to have only one nozzle operatively associated with the input line 10, or two nozzles operatively associated with the input line 10, or three nozzles operatively associated with the input line 10. These nozzles, in the preferred embodiment, are of a projecting spout design. Also, the nozzle could take the form of a circular member disposed about the inner diameter of the throat 4, with individual nozzles disposed thereon. The manifold 10 is a system of tubular members operatively connected to the jet nozzles in order to deliver the solution and/or material to the jets 14,16,18,20.

Although not shown, a reservoir may be included that will feed the pump 12 with the solution and/or material, which is connected with the pump via line 24. The line 24 is fluidly connected to the manifold 10 so that the solution and/or material is delivered to the jet nozzles 14,16,18,20. A valve member 25 is included in the line 24.

FIG. 1 also depicts a liquid barrier line 26 in fluid communication with the throat section 4. The liquid barrier line 26 is capable of delivering a liquid into the inner diameter of the throat 4. A valve member 28 is included in order to open the line 26 to communicate fluid from the tank into the inner diameter of the throat 4. A valve stem 29 is included, with the valve stem 29 capable of turning the valve 28 into an open position or a closed position at the option of the operator. The liquid barrier line 26 is connected to the throat 4 just above the mixing chamber 6 to provide enough volume to create a column of fluid above a jet that is located in the mixing chamber 6, thus keeping air out of the mixing chamber.

Figure 2:
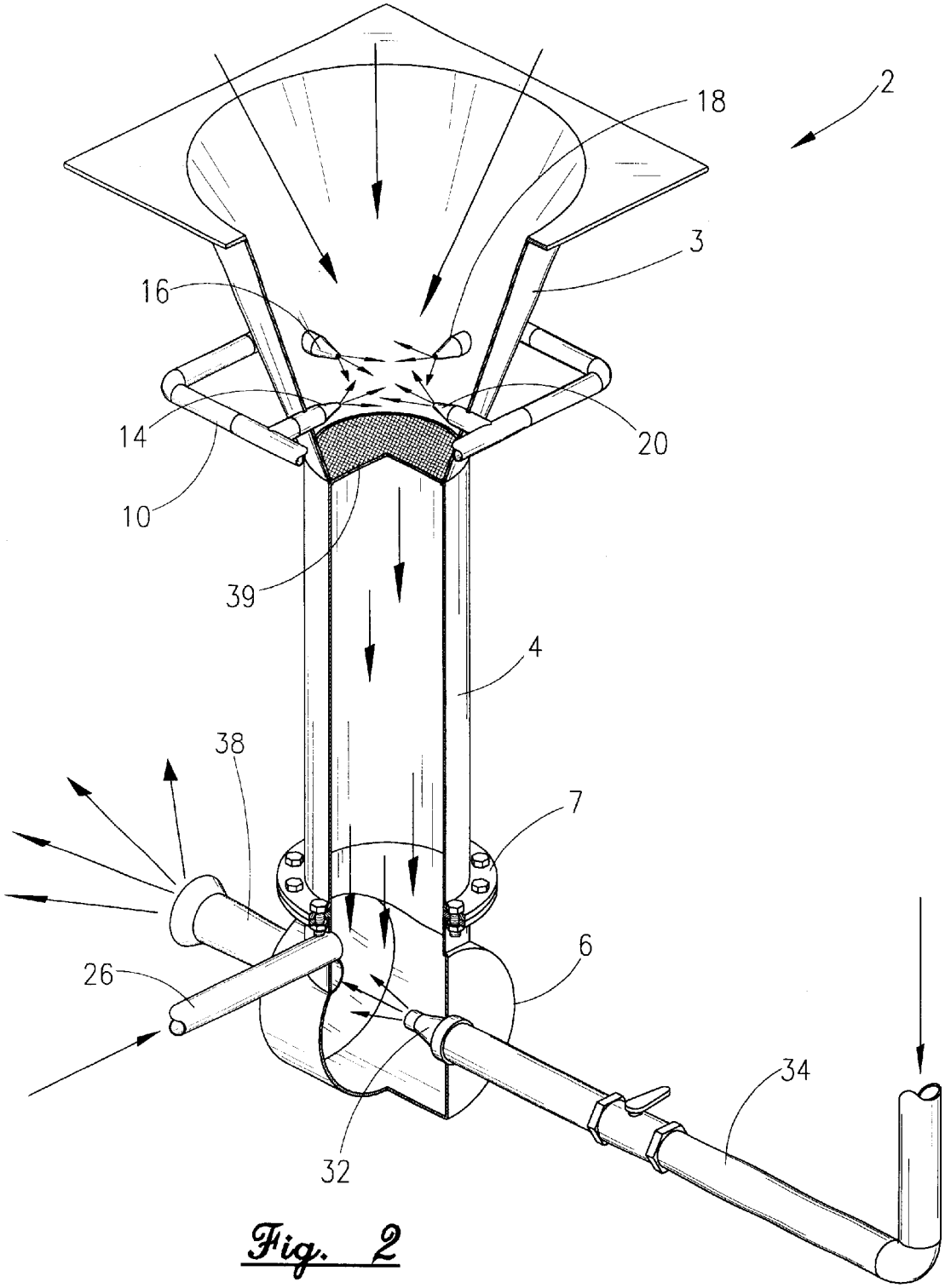
FIG. 2 is a cut-away view of the embodiment of FIG. 1.

With reference to FIG. 2, which is a cut-away view of the embodiment of FIG. 1, it can be seen that the mixing chamber 6 includes a jet nozzle 32. The line 26 is connected to the throat 4 just above the jet 32 of the mixing chamber. As mentioned earlier, the open line 26 will create a head of fluid that creates a liquid barrier above said jet 32 thereby keeping air out of the mixing chamber. In the preferred embodiment of the present application, the liquid is the contents of the drilling fluid tank although it is possible to use other fluids and/or dry materials. The jet nozzle 32 is fluidly connected via the input line 34 to the pump member 42, with the pump member being similar to the pump member 12 previously described. The jet nozzle 32 is commercially available from Hal Oil Field Pump & Equipment Corporation under the mark Halco Jets. Alternatively, a polymer type of nozzle may be employed, wherein said polymer nozzles are also commercially available. The pump 42 will be capable of pumping either a fluid solution or a bulk material. It should be noted that like numerals appearing in the various figures refer to like components. Additionally, a screen 39 is placed into throat in order to collect large, solid particles, such as drill cuttings from the well bore. Also shown is the jet nozzle 32 with the solution exiting therefrom.

The mixing within the mixing chamber 6 is known as the venturi effect. As the solution exits the jet nozzle 32 under pressure, a transfer of energy takes place within the chamber 6, which is referred to as the venturi effect. As the solution exits the nozzle 32 under a high pressure, the material (which is at a low pressure entering the mixing chamber 6) is mixed with the high pressure solution, and the resultant slurry within the mixing chamber 6 (now at a higher pressure than the original material in the throat section 4) will seek an exit at the lower pressure outlet 38. This venturi effect causes not only the mixing of the bulk material with the solution into a slurry, but also aids in ejecting the slurry under pressure to the outlet 38, with the outlet 38 being a conical shaped exit tube. In the case of the preferred embodiment, the slurry exits outlet 38 into the mud holding tank, with the slurry being capable of use within the well bore. The slurry will be directed into the well bore using conventional means such as drill pipe.

Figure 3:
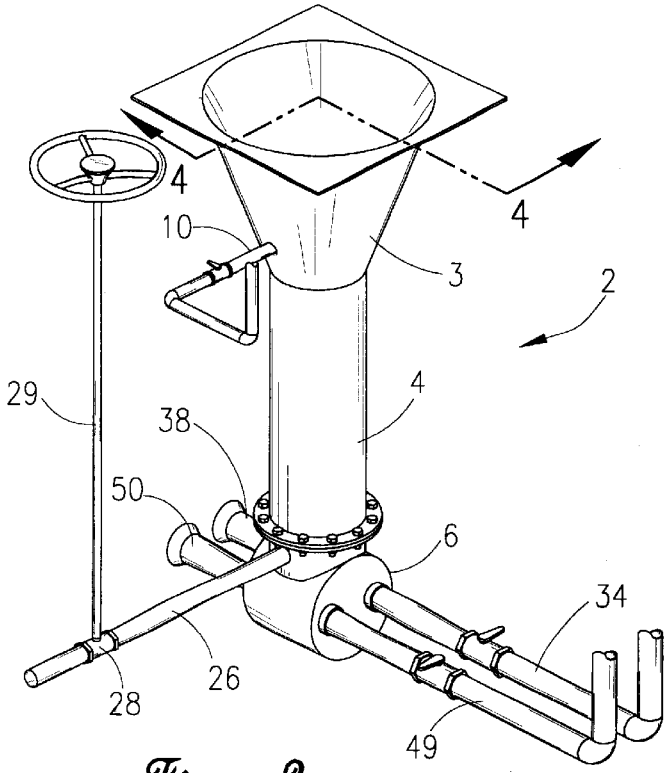
FIG. 3 is a perspective view of the second embodiment of the present invention containing multiple jets within the mixing chamber.

Referring now to FIG. 3, a perspective view of the second embodiment of this invention will now be described. As noted earlier, like numbers appearing in the various figures refer to like components. This second embodiment contains multiple jets within the mixing chamber 6, which is the preferred embodiment of this application. The hopper 2 extends to the throat section 4 which in turn extends to the mixing chamber 6. The manifold line 10 attaches to a jet (not shown in FIG. 3) within the funnel section 3. The FIG. 3 also illustrates the second input line 49 into the chamber and the associated output line 50 from the chamber 6.

Figure 4:
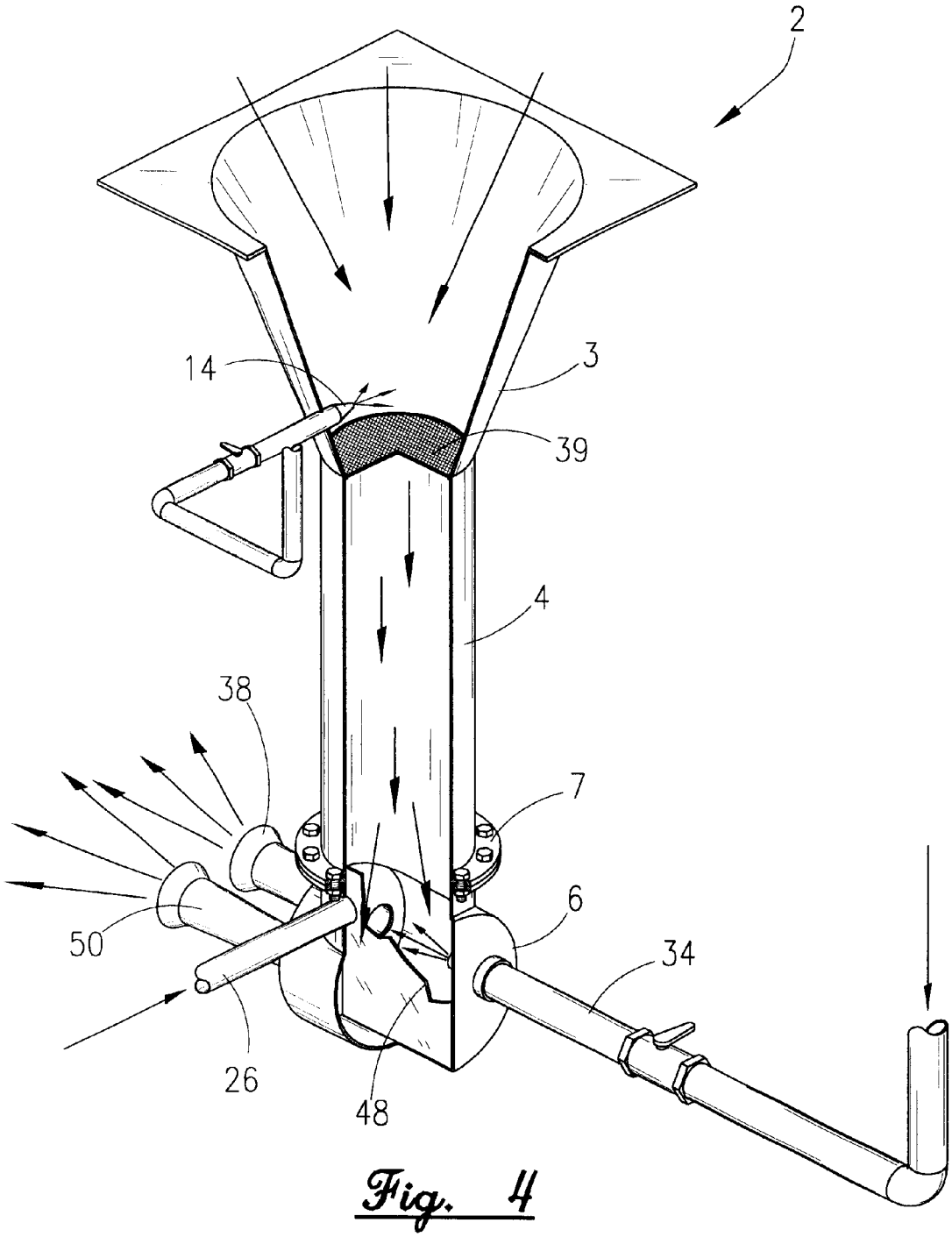
FIG. 4 is a cut-away view of the embodiment of FIG. 3.

Referring now to FIG. 4, which is a cut-away view of the preferred embodiment of FIG. 3, a second jet nozzle (which is seen as item 40 in FIG. 6) is included within the mixing chamber 6. This second jet nozzle 40 is operatively connected to the pump member 42 via the line 44, with the pump member 42 receiving from a reservoir of a solution that is to be injected into the mixing chamber 6. The second jet nozzle 40 is of similar construction to the jet nozzle 32 and injects the liquid under pressure as previously described.

FIG. 4 further depicts the ceramic plate 48 that is positioned between the first jet nozzle 32 and the second jet nozzle 40. The second inlet 44 is included and associated with the jet nozzle 40. Also included is the second outlet 50 which is operatively associated with the second jet nozzle 40, the same as the first jet nozzle 32 is operatively associated with the outlet 38. The ceramic plate 48 acts to separate and channel the solution which is exiting the jet nozzles 32, 40 as well as directing the resulting slurry to respective outlets, 38 and 50. The ceramic plate also acts to prevent cavitation within the mixing chamber 6. The method of mixing bulk material is similar as to the embodiment of FIG. 1 except that with the multiple jets within the mixing chamber 6, the venturi effect is increased, a greater amount of agitation is achieved, and the output from the outlets 38,50 is increased. In other words, the venturi effect is enhanced which in turn mixes the slurry/material faster and more effectively.

Figure 6:
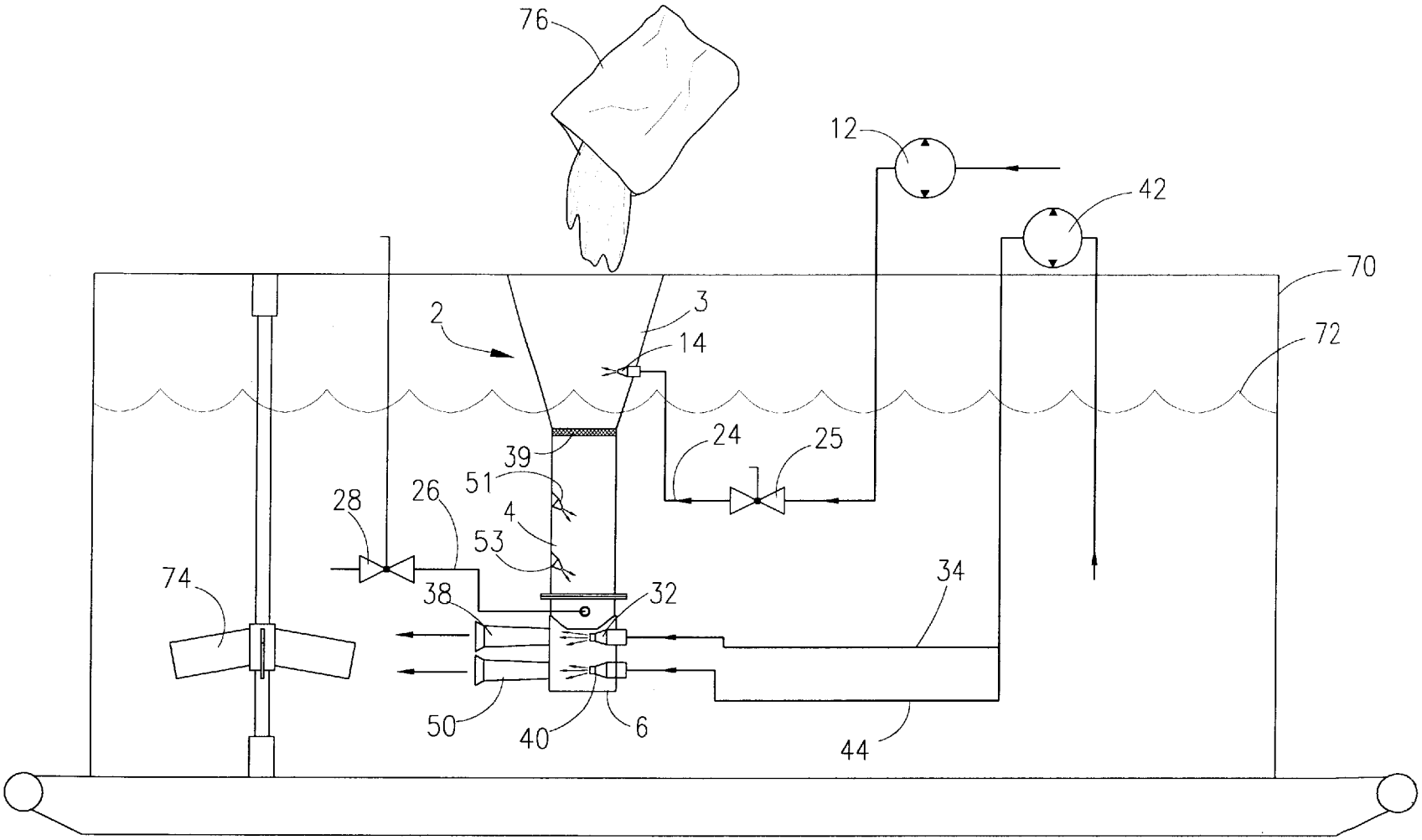
FIG. 6 is a schematic presentation of the second embodiment of FIG. 3 as a system in a mud tank.

The embodiments may also include cleaning nozzles. More particularly, this embodiment may include two cleaning nozzles that are similar in construction as the nozzles 14, 16, 18, 20. The nozzles are operatively associated with a pump member via a feed line. Due to the nature of the materials and solutions that are being mixed within the mixing chamber 6, the nozzles 32,40 may become plugged or clogged. The nozzles 51, 53 (as seen in FIG. 6) are directed at the previously described nozzles 32,40 in order to clean the nozzles 32,40. The injection of a solution is done periodically and generally not continuously, even though the frequency will depend on the unique characteristics of individual slurries.

Figure 5:
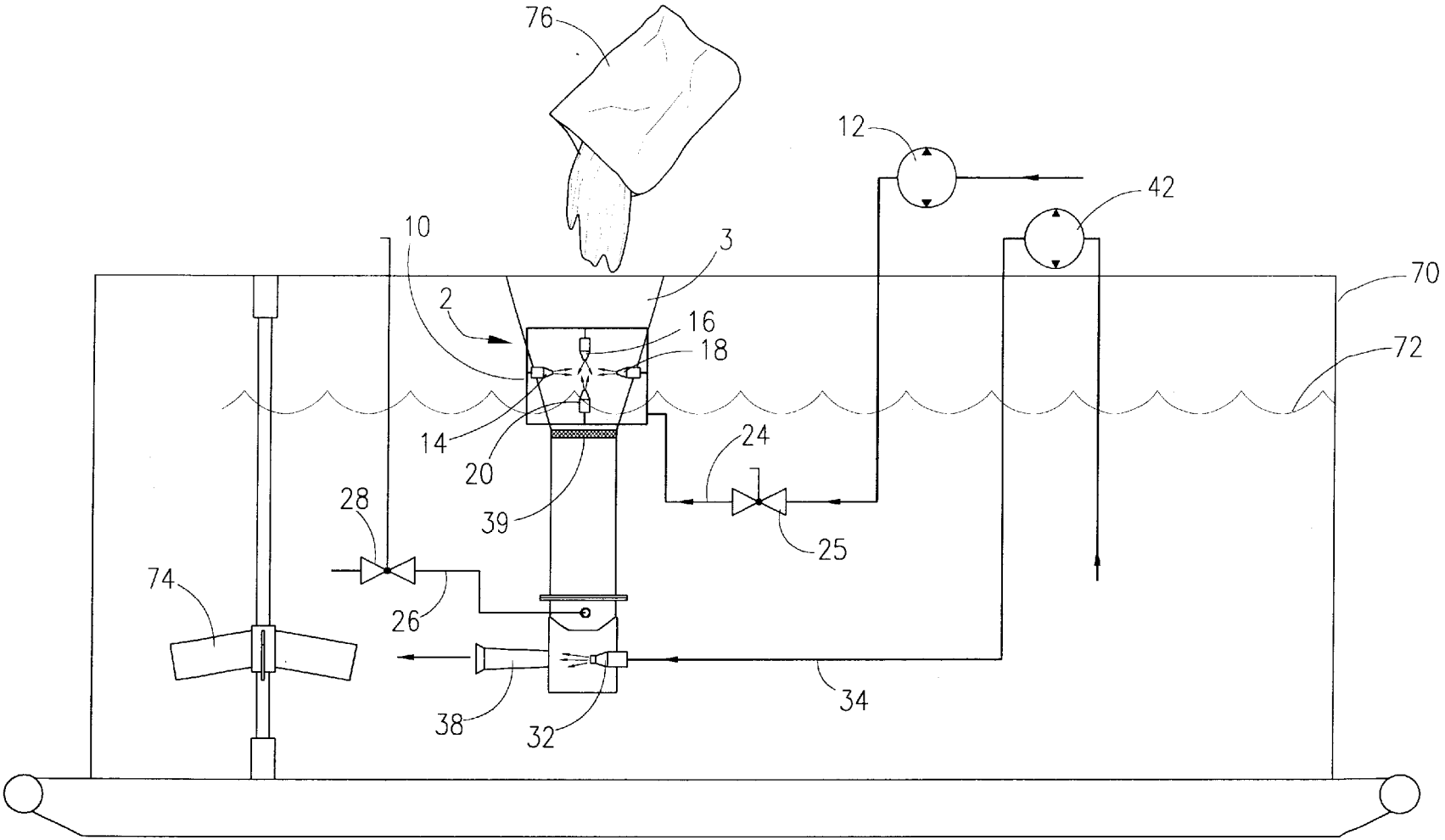
FIG. 5 is a schematic presentation of the first embodiment of FIG. 1 as a system in a mud tank.

FIG. 5 is a schematic representation of the first embodiment shown in FIG. 1 as a system in a drilling fluid tank 70. Tank 70 contains the drilling fluid that is pumped into and out of the well bore, as is understood by those of ordinary skill in the art. The slurry within tank 70 is pumped into the well bore through a tubular member, for instance a drill string. The drill string within the well bore forms an annulus. Therefore, the slurry is pumped down the inner diameter of the drill string and out the drill string end to the annulus. The slurry is then ultimately circulated back into the tank 70 for storage, reconditioning, recirculation, treatment, etc. as is well understood by those of ordinary skill in the art. It is also possible to reverse circulate down the annulus and into the drill string. The mud tank 70 contains a drilling fluid level 72 along with a paddle 74 for stirring the drilling fluid to prevent, for instance, settling or gelling of the drilling fluid. Therefore, a sack of dry material 76 is being dumped into the hopper 2. The jet 14 will mix the material with a preselected liquid, as previously described. The liquid barrier line 26 is in the open position so that a liquid column is created above the jet 32, also as previously described. A solution is being injected via the input lines 34, 44, and the material is mixed via the venturi effect within the mixing chamber 6. The slurry, which has been properly mixed and contains a minimum amount of air, is then exited from the output 38.

FIG. 6 is a schematic representation of the second embodiment of the present invention shown in FIGS. 3 and 4 as a system in the mud tank 70. The mud tank 70 contains the drilling fluid that is pumped into and out of the well bore, as stated earlier. The mud tank 70 contains a drilling fluid level 72 along with the paddle 74 for stirring the drilling fluid as stated previously. Again, a sack of dry material 76 is being dumped into the hopper 2. The jet 14 will mix the material with a preselected liquid, as previously mentioned. The liquid barrier line 26 is in the open position so that a liquid column is produced above the jet 32 and jet 40, also as previously described. A solution is being injected via the input lines 34,44, and the material is mixed via the venturi effect within the mixing chamber 6. The slurry is then exited from the output 38 lines 50.

While preferred embodiments of the present invention have been described, it is to be understood that the embodiments described are illustrative only and that the scope of the invention is to be defined solely by the appended claims when accorded a full range of equivalence, many variations and modifications naturally occurring to those skilled in the art from a perusal hereof.

We claim:

1. A method of mixing a bulk material with a drilling fluid comprising:

providing a drilling fluid tank with the drilling fluid therein;

placing the bulk material into a hopper, said hopper having a throat section extending therefrom, and wherein said throat section extends to a mixing chamber;

descending the bulk material into said throat section;

injecting a solution into the hopper so that air within said bulk material is removed;

channeling the bulk material and the solution from the throat section into the mixing chamber;

communicating a liquid into the throat section through an inlet located above said mixing chamber so that a barrier of liquid is kept above a jet in said mixing chamber so that the air is kept out of said mixing chamber;

injecting the drilling fluid into the jet of said mixing chamber to form a slurry within said mixing chamber and wherein said step of injecting the drilling fluid into the mixing chamber comprises a first nozzle and a second nozzle positioned within said mixing chamber, and a ceramic plate positioned between said first nozzle and said second nozzle;

exiting the slurry from the mixing chamber into the drilling fluid, and wherein said step of exiting the slurry includes exiting from a first outlet line located on said mixing chamber and exiting from a second outlet line located on said mixing chamber.

2. The method of claim 1 wherein the step of injecting the solution into the hopper includes injecting the solution into a plurality of nozzles positioned within an inner diameter of said hopper.

3. The method of claim 1 wherein the step of injecting the solution into the hopper is performed with a pump means for pumping the solution into said hopper.

4. A mixing device comprising:

a drilling fluid tank having a drilling fluid therein;

a hopper operatively associated with said drilling fluid tank, said hopper having a throat section extending therefrom, said hopper having disposed therein a first product;

a first jet nozzle connected to said hopper, said first jet nozzle introducing a second product into said hopper and wherein said first jet nozzle is positioned within said hopper, said first jet nozzle member being positioned to deliver the second product into the hopper under a pressure force;

a second jet nozzle connected to said hopper to deliver the second product into the hopper under the pressure force, a mixing bowl in communication with said throat section and adapted to receive said first product and said second product:

a venturi means, positioned within said mixing bowl, for injecting the second product into said mixing bowl and mixing said second product with said first product to form a slurry and wherein said venturi means comprises a third jet nozzle and a fourth jet nozzle, said third jet nozzle and said fourth jet nozzle being connected to a pump member for delivering the solution under the pressure force;

a first exit line extending from said mixing bowl in order to withdraw the slurry, and wherein said third jet nozzle is associated with said first exit line;

a liquid barrier line in fluid communication with said throat section, said liquid barrier line capable of delivering said drilling fluid into said throat section;

a second exit line, said second exit line being associated with said fourth jet nozzle;

a ceramic plate positioned between said third jet nozzle and said fourth jet nozzle, said ceramic plate acting to channel the solution from the third jet nozzle to said first exit line and channel the solution from said fourth jet nozzle to said second exit line.

5. The device of claim 4 further comprising a directional cleaning nozzle positioned in said throat section, said directional cleaning nozzle being angled to deliver the solution to said third jet nozzle and said fourth jet nozzle of said venturi means.

* * * * *